US010315892B2

(12) United States Patent
Almeda et al.

(10) Patent No.: US 10,315,892 B2
(45) Date of Patent: Jun. 11, 2019

(54) PORTABLE DAVIT

(71) Applicants: Benjamin M. Almeda, Tumwater, WA (US); Patrick B. Almeda, Tumwater, WA (US)

(72) Inventors: Benjamin M. Almeda, Tumwater, WA (US); Patrick B. Almeda, Tumwater, WA (US)

(73) Assignee: Patrick B. Almeda, Tumwater, WA (US)

( * ) Notice: Subject to any disclaimer, the term of this patent is extended or adjusted under 35 U.S.C. 154(b) by 712 days.

(21) Appl. No.: 14/609,365

(22) Filed: Jan. 29, 2015

(65) Prior Publication Data

US 2016/0221802 A1 Aug. 4, 2016

(51) Int. Cl.

| | |
|---|---|
| ***B66C 23/18*** | (2006.01) |
| ***B66C 23/16*** | (2006.01) |
| ***B66C 23/52*** | (2006.01) |
| ***B66D 3/08*** | (2006.01) |
| ***B66C 23/60*** | (2006.01) |

(52) U.S. Cl.

CPC ..... *B66C 23/18* (2013.01); *B66C 23/166* (2013.01); *B66C 23/52* (2013.01); *B66C 23/60* (2013.01); *B66D 3/08* (2013.01)

(58) Field of Classification Search

CPC ..... B66C 23/00; B66C 23/06; B66C 23/16; B66C 23/163; B66C 23/166; B66C 23/18; B66C 23/20; B66C 23/203; B66C 23/26; B66C 23/365; B66C 23/52; B66C 23/60; B66C 23/605; B66C 23/36

See application file for complete search history.

(56) References Cited

U.S. PATENT DOCUMENTS

| | | | | |
|---|---|---|---|---|
| 2,288,354 A * | 6/1942 | Hill | B66C 23/202 | 212/179 |
| 2,804,216 A * | 8/1957 | Farnam | B66C 23/36 | 212/252 |
| 4,560,074 A * | 12/1985 | Manning | B66C 23/203 | 212/179 |
| 5,807,059 A * | 9/1998 | Takeda | B66C 23/18 | 414/609 |
| 5,934,490 A * | 8/1999 | Mora | B25H 1/0007 | 212/176 |
| 6,401,863 B1 * | 6/2002 | Kirkland | B66D 3/20 | 182/142 |

(Continued)

*Primary Examiner* — Michael R Mansen
*Assistant Examiner* — Juan J Campos, Jr.
(74) *Attorney, Agent, or Firm* — Christensen O'Connor Johnson Kindness PLLC

(57) ABSTRACT

Embodiments of the present invention are generally directed to davits for raising, lowering, and transporting loads. In general, davits described herein are portable and are capable of attaching to various mounting locations. The portable davit 100 includes a base mount 102 and an intermediate mount 104 for mounting the portable davit 100 to a mounting location. The base mount 102 and the intermediate mount 104 are couplable to a mast 106 for supporting the portable davit 100 when generally carrying a load L. The portable davit 100 also includes a jib 108 hingedly coupled to the mast 106 through a coupling 118. The jib 108 is configured to rotate about the coupling 118 such that the jib 108 is positionable at a lifting angle 120.

16 Claims, 7 Drawing Sheets

(56) References Cited

U.S. PATENT DOCUMENTS

| | | | | |
|---|---|---|---|---|
| 6,763,635 | B1 * | 7/2004 | Lowman | B60P 1/5433 378/198 |
| 7,681,747 | B2 * | 3/2010 | Crowder | B66C 23/22 212/166 |
| 2003/0006403 | A1 * | 1/2003 | Vetesnik | A62B 1/06 254/334 |
| 2006/0163186 | A1 * | 7/2006 | Choate | B66C 23/166 212/175 |
| 2008/0035594 | A1 * | 2/2008 | Crowder | B66C 23/22 212/179 |
| 2012/0223042 | A1 * | 9/2012 | McNiff | B66C 23/166 212/295 |
| 2014/0054526 | A1 * | 2/2014 | Kalakay, Jr. | B66D 3/26 254/226 |

* cited by examiner

PORTABLE DAVIT

BACKGROUND

A davit is generally used to raise and lower a load at a projected distance away from a mounting location. One common use of davits is raising a load from water, swinging the load over a boat's hull, and then lowering the load to the deck. Performing these steps in reverse order to place an object in the water is also common. Davits are generally permanently mounted to a mounting surface and are often heavy and difficult to transport. However, in certain instances a user may transport the davit from one mounting location to another to utilize the function of the davit in multiple locations, e.g., from a boat to a truck. Therefore, a need exists for improved portability of davits to allow for transportation between areas and installation in multiple mounting locations. Embodiments of the present disclosure are directed to fulfilling these and other needs.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter. In accordance with one embodiment of the present disclosure, a portable davit for raising, lowering, and transporting a load is provided. The portable davit generally includes at least one mount for mounting the portable davit to a mounting location, an elongate mast rotatably couplable to the mount, the mast extending from the mount, a jib hingedly couplable to an upper section of the mast, wherein the jib is positionable at a desired lifting angle, a pulley system mountable on the mast and the jib, wherein the pulley system includes a line removably couplable to the load, and a collar joint disposed between the mast and the at least one mount, the collar joint configured to allow rotation of the mast relative to the mount and to lock the mast in fixed position relative to the mount.

In accordance with another embodiment of the present disclosure, a portable davit for raising, lowering, and transporting a load is provided. The portable davit generally includes at least one mount for mounting the portable davit to a mounting location, an elongate mast rotatably coupled to the mount, a jib hingedly coupled to an upper end of the mast, an actuator connected to the mast and the jib, wherein the actuator is operable to adjust a lifting angle between the mast and the jib, and a pulley system for raising and lowering the load. The pulley system generally includes a line removably couplable to the load, a sheave mountable on the mast, the sheave operable to pass out and reel in the line, wherein the sheave is drivingly connected to a motor, and a lifting pulley mountable on the jib, the lifting pulley guiding the line between the sheave and the load.

In accordance with any of the embodiments described herein, the pulley system may include a sheave mountable on the mast, the sheave operable to pay out and reel in the line.

In accordance with any of the embodiments described herein, the sheave may be drivingly connected to a motor.

In accordance with any of the embodiments described herein, the motor may be electric powered.

In accordance with any of the embodiments described herein, the portable davit may include a controller electrically connected to the motor for controlling the level of torque applied by the motor to the sheave.

In accordance with any of the embodiments described herein, the pulley system may include a lifting pulley mountable on the jib, the lifting pulley may guide the line between the sheave and the load.

In accordance with any of the embodiments described herein, the lifting pulley may include a guard coupled to the pulley system, wherein the guard may be configured to interface the line.

In accordance with any of the embodiments described herein, the portable davit may include a handle coupled to the collar joint, wherein the handle may be configured to rotate the mast relative to the mount.

In accordance with any of the embodiments described herein, the mast may be at least partially hollow in construction.

In accordance with any of the embodiments described herein, the mast may be manufactured from a material selected from the group consisting of aluminum, titanium, carbon fiber, steel, iron, polyvinyl chloride, acrylonitrile butadiene styrene, and fiberglass.

In accordance with any of the embodiments described herein, the jib may be at least partially hollow in construction.

In accordance with any of the embodiments described herein, the jib may be manufactured from a material selected from the group consisting of aluminum, titanium, carbon fiber, steel, iron, polyvinyl chloride, acrylonitrile butadiene styrene, and fiberglass.

In accordance with any of the embodiments described herein, the portable davit may include an actuator extending between the mast and the jib, wherein the actuator may be operable to adjust the lifting angle between the mast and the jib, wherein the actuator may be coupled to the mast and the jib with pinned joints. In accordance with any of the embodiments described herein, the actuator may be operated by one of the following systems: hydraulic, electrical, or manual.

In accordance with any of the embodiments described herein, the lifting angle may be adjustable between about 50 degrees and 150 degrees.

In accordance with any of the embodiments described herein, the collar joint may include discrete rotational locking positions with the mast such that the rotatable coupling of the mast may be selectively stopped.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

The detailed description set forth below in connection with the appended drawings, where like numerals reference like elements, are intended as a description of various embodiments of the present invention and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the following description, specific details are set forth to provide a thorough understanding of exemplary embodiments of the present invention. It will be apparent to one skilled in the art, however, that the invention may be practiced without embodying all of the specific details. In some instances, well-known process steps have not been described in detail in order not to unnecessarily obscure various aspects of the present disclosure. Further, it will be appreciated that embodiments of the present invention may employ any combination of features described herein.

The present application may include references to directions, such as "forward," "rearward," "front," "back," "upward," "downward," "right hand," "left hand," "lateral," "medial," "in," "out," "extended," "advanced," "retracted," "proximal," "distal," "central," etc. These references, and other similar references in the present application, are only to assist in helping describe and understand the particular embodiment and are not intended to limit the present invention to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc.

Embodiments of the present disclosure are generally directed to davits for raising, lowering, and transporting loads. In general, davits described herein are portable and are capable of attaching to various mounting locations. Portable davits of the present disclosure are suitably installed in locations where permanent davits are not economically viable, physically feasible, or where permanent mounting of a davit is not desired (e.g., in the bed of a pickup truck, on board a boat, etc.). Portable davits in accordance with the present invention are capable of being disassembled into smaller sections such that the davit may be transported or stored when not in use.

Figure 1:
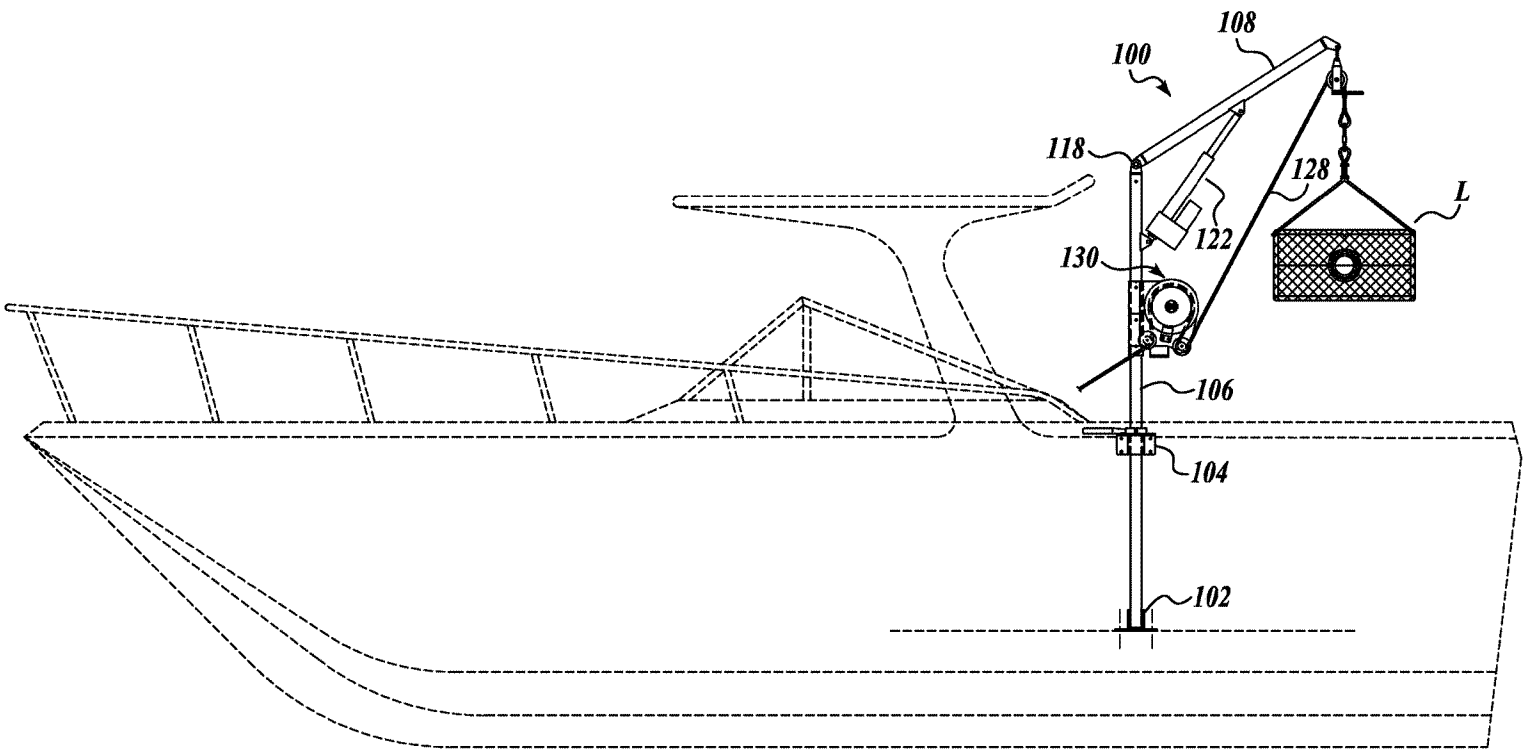
FIG. 1 is a perspective view of a portable davit formed in accordance with one embodiment of the present disclosure, showing the portable davit coupled to a mounting location.
Figure 2:
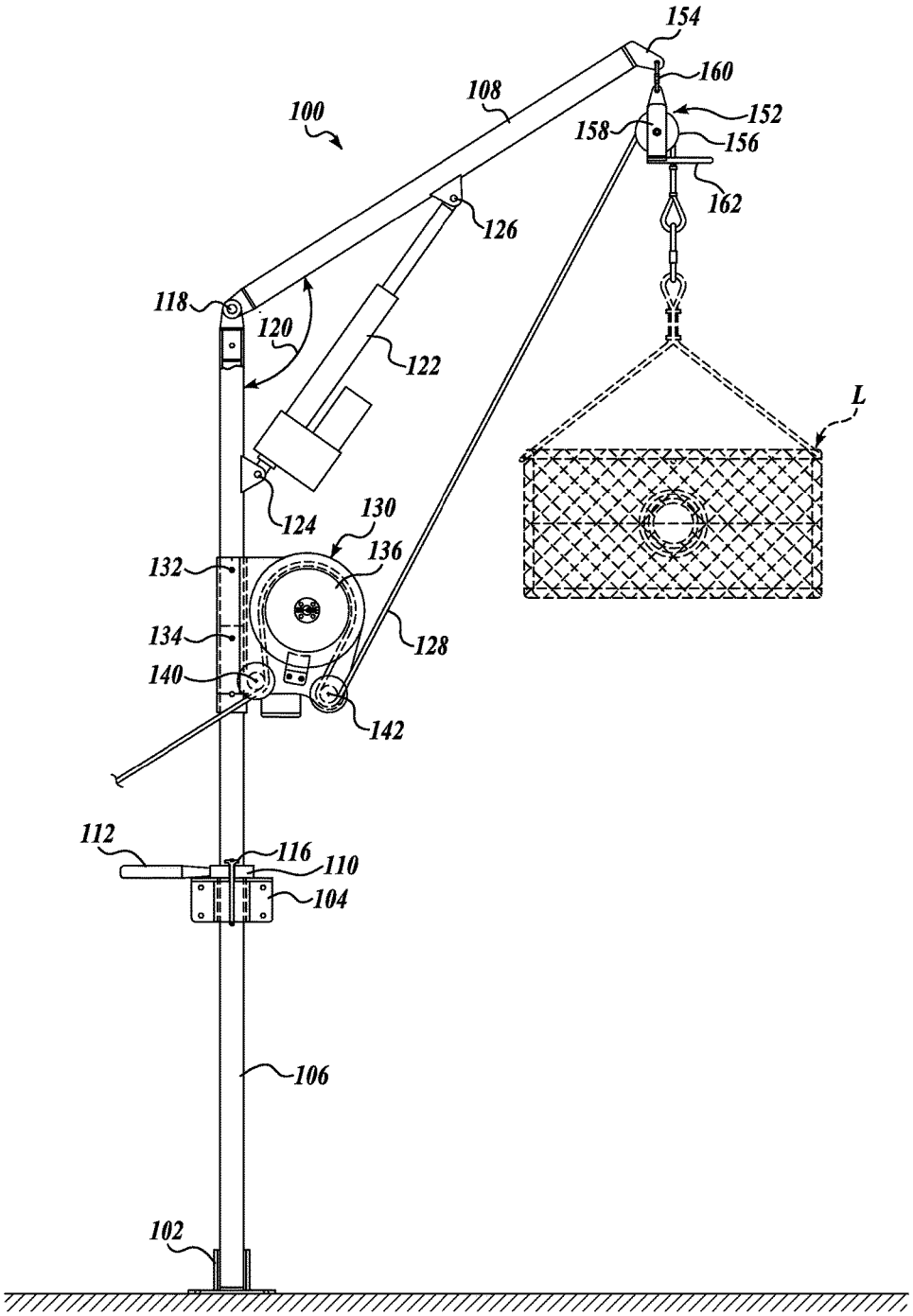
FIG. 2 is an elevational view of the portable davit of FIG. 1 with the jib in a fully lifted position.
Figure 3:
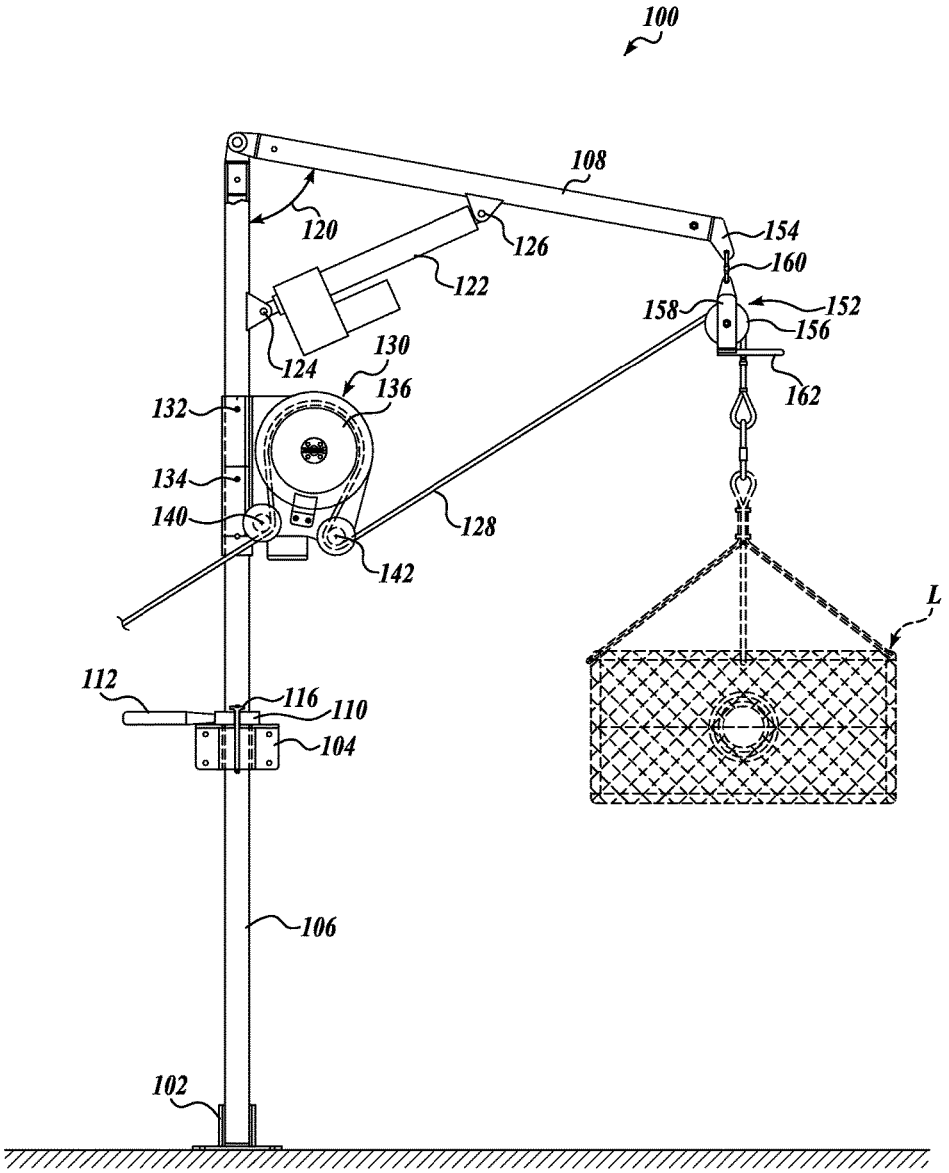
FIG. 3 is an elevational view of the portable davit of FIG. 1 with the jib in a fully lowered position.

A first embodiment of a portable davit 100 in accordance with the present invention is shown in FIGS. 1-3. The portable davit 100 includes a base mount 102 and an intermediate mount 104 for mounting the portable davit 100 to a mounting location. The base mount 102 and the intermediate mount 104 are couplable to a mast 106 for supporting the portable davit 100 when generally carrying a load L. As shown in the illustrated embodiment, the intermediate mount 104 is located at a point along the mast 106 such that the mast 106 is laterally supported in position. However, in other embodiments, the intermediate mount 104 is adjustable to any location along the length of the mast 106 to adapt to different installation heights. In some embodiments, a single mount is sufficient to support the portable davit. In other embodiments, the base mount 102 and multiple intermediate mounts 104 are used to support the portable davit.

The coupling of mast 106 in the base mount 102 and the intermediate mount 104 is rotatable such that the mast 106 rotates around a longitudinal axis. In some embodiments, the rotation of the mast 106 is facilitated by low-friction devices within each mounting location. Examples of low-friction devices are a bearing 150 (see FIG. 8), a low-friction bushing 166 (see FIG. 5), a lubricant (not shown), or a combination of low-friction devices. The low-friction bushing 166 is constructed from any suitable material, such as nylon, graphite, polytetrafluoroethylene, silicone, paraaramid synthetic fiber, and other plastics, resins, and polymers. In this regard, any low-friction device is suitably used in the mounts to facilitate rotation of the mast 106.

Figure 6:
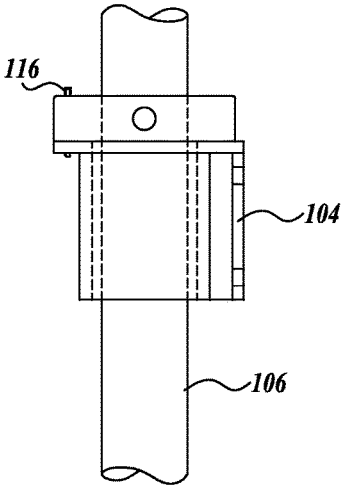
FIG. 6 is a close-up side view of the intermediate mount of the portable davit of FIG. 1.
Figure 8:
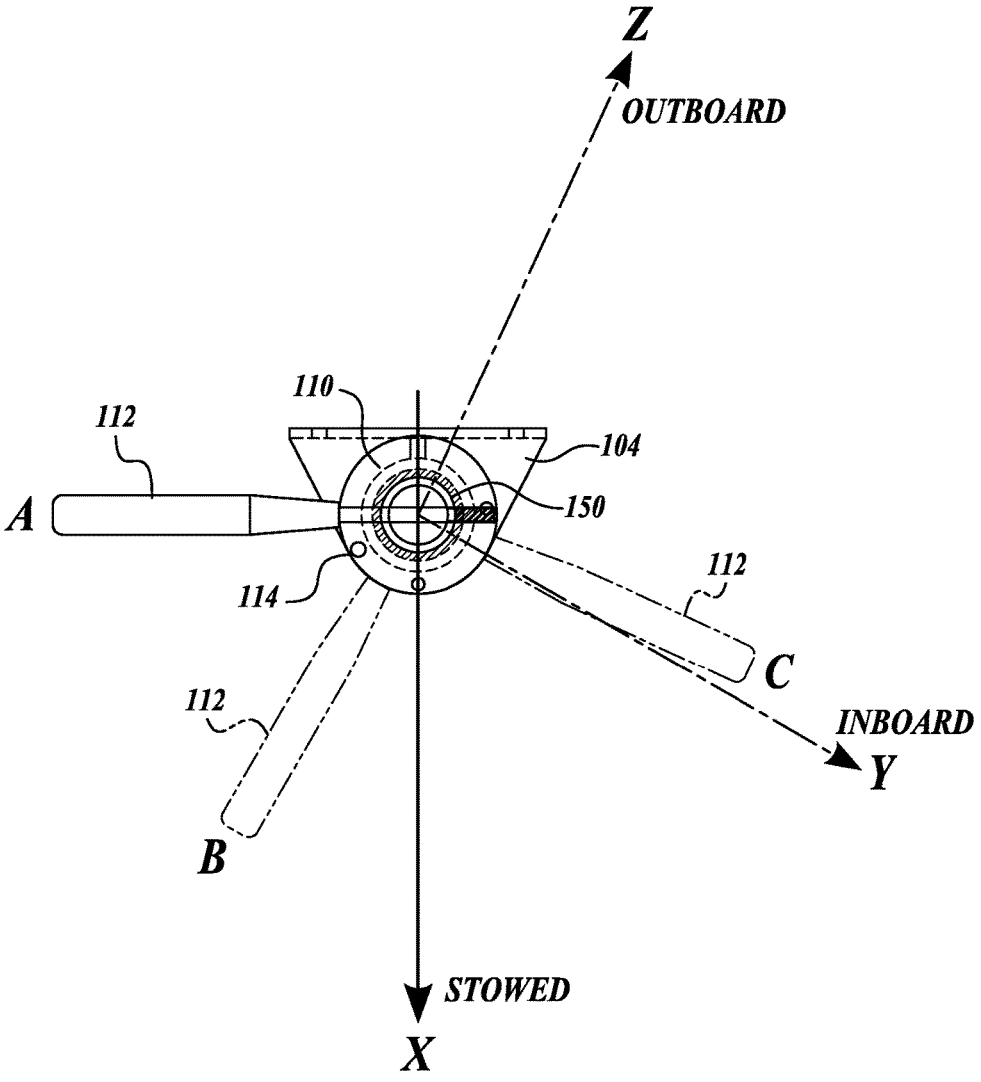
FIG. 8 is a top view of the intermediate mount of the portable davit of FIG. 1, showing the rotational positioning of the portable davit.

As shown most clearly in FIG. 8, the intermediate mount 104 includes a collar joint 110 to allow rotation of the mast 106. A handle 112 is coupled to the collar joint 110 to provide leverage while rotating the mast 106. The collar joint 110 includes a plurality of circumferential bores 114. Each bore 114 in the collar joint 110 includes a corresponding bore (not shown) in the underlying intermediate mount 104. When a bore 114 in the collar joint 110 is aligned with a bore in the intermediate mount 104, a pin 116 (see also, FIG. 6) is inserted through the bores to lock the rotation of the mast 106 at discrete locations. In the illustrated embodiment, three discrete locking positions are included, depicted as handle positions A, B, and C, which place the jib 108 in locations X, Y, and Z, respectively. The locations X, Y, and Z are labeled as stowed, inboard, and outboard, respectively, to show one possible configuration of the handle 112 with respect to the jib 108. In other embodiments, any number of discrete locking positions is suitably used, including infinitely variable locking schemes. Likewise, the handle 112 is positionable at any orientation with respect to the jib 108.

Referring to FIG. 2, the portable davit 100 also includes a jib 108 hingedly coupled to the mast 106 through a coupling 118. The jib 108 is configured to rotate about the coupling 118 such that the jib 108 is positionable at a lifting angle 120. The lifting angle 120 is the included angle between the mast 106 and the jib 108. In some embodiments, the lifting angle 120 is adjusted such that the load L is lifted over certain obstacles, for example, the side of a truck bed, or the side of a boat hull. In the illustrated embodiment, the lifting angle 120 is adjustable between about 80 degrees (see FIG. 3) and about 125 degrees (see FIG. 2). In other embodiments, the lifting angle is adjustable between about 50 degrees and 150 degrees.

In some embodiments, the mast 106 and the jib 108 are at least partially hollow in construction to reduce the weight of the components. In this regard, the mast 106 and the jib 108 are manufactured from a variety of materials, for example, aluminum, titanium, carbon fiber, graphite, steel, stainless steel, iron, polyvinyl chloride, acrylonitrile butadiene styrene, and fiberglass, or any combination thereof.

The lifting angle 120 is adjustable using an actuator 122 coupled to the mast 106 at a mast tab 124, and coupled to the jib 108 at a jib tab 126. In some embodiments, the coupling at the mast tab 124 and the jib tab 126 are pinned joints. In other embodiments, other coupling methods are suitably used. In the illustrated embodiment, the actuator 122 is extended and retracted with electric power. In other embodiments, the actuator 122 is extended and retracted with hydraulic power, or by manual input. In some of the manual input embodiments, the actuator 122 includes a torque-multiplying device. The actuator 122 is suitably extended (see FIG. 2) and retracted (see FIG. 3) to adjust the lifting angle 120. Although the actuator 122 is illustrated in all the FIGURES as fully extended or fully retracted, the actuator 122 is adjustable to any intermediate location.

The portable davit 100 includes a line 128, removably couplable to the load L, to raise, lower, and transport the load L. The line 128 is paid out and reeled in with a sheave assembly 130. In the illustrated embodiment of FIG. 2, the sheave assembly 130 is mountable on the mast 106 at a first sheave mount 132 and a second sheave mount 134. However, in other embodiments, a single mount, or more than two mounts are used to mount the sheave assembly 130 to the mast 106.

Figure 5:
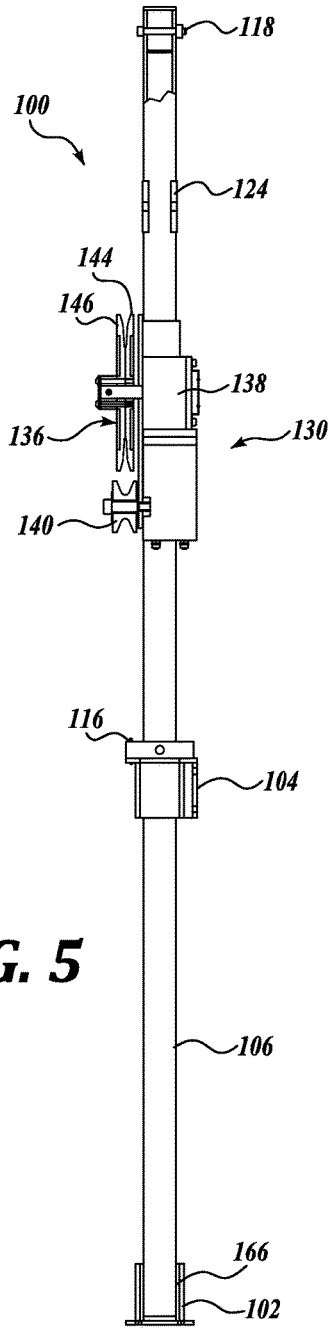
FIG. 5 is a side view of the portable davit of FIG. 1.
Figure 7:
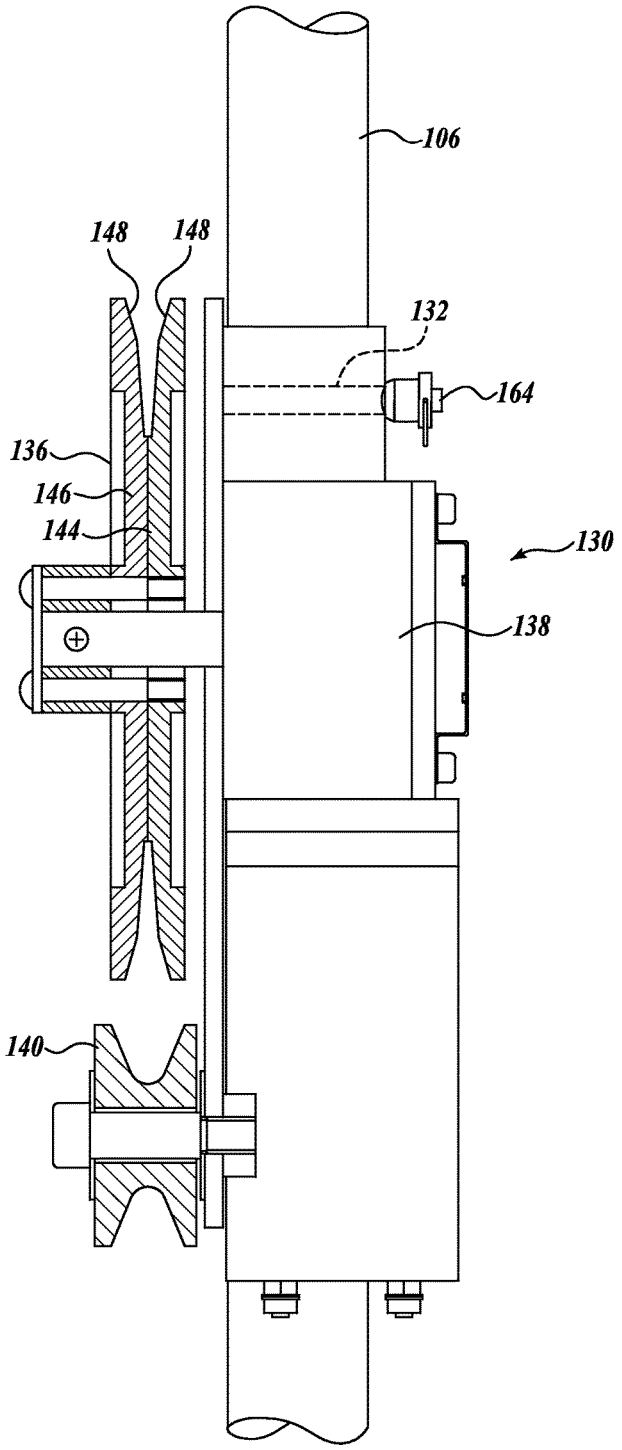
FIG. 7 is a close-up side view of the sheave assembly of the portable davit of FIG. 1, showing the sheave pulley and the guide pulley in cross section.

The sheave assembly 130 generally includes a sheave pulley 136 configured to grip the line 128 to pay out and reel in the line 128 during raising and lowering maneuvers. As shown in FIGS. 5 and 7, in one embodiment, the sheave pulley 136 comprises two halves: (1) a first sheave pulley component 144; and (2) a second sheave pulley component 146. Each pulley component is machined with a radial taper 148, as shown most clearly in FIG. 7. When the first and second sheave pulley components 144 and 146 are combined, the included shape of the sheave pulley 136 grips the line 128. In other embodiments, the sheave pulley 136 is manufactured as a single component. Likewise, in other embodiments, the sheave pulley 136 is manufactured by greater than two components.

Referring to FIGS. 5 and 7, in the illustrated embodiment, the sheave pulley 136 of the sheave assembly 130 is drivingly connected to an electric motor 138. In some embodiments, a gear motor assembly (not shown) is attached to the output shaft of the electric motor 138 to alter the speed and torque transferred to the sheave assembly 130. In this instance, the sheave assembly 130 is drivingly connected to a gear motor output shaft and is indirectly driven by the output shaft of the electric motor 138. The electric motor 138 enables rotation of the sheave pulley 136 to pay out or reel in the line 128. In this regard, the electric motor 138 is able to turn the sheave pulley 136 in both a clockwise and a counterclockwise direction.

In some embodiments, the sheave assembly 130 includes a controller (not shown) to control the electric motor 138. As non-limiting examples, the controller is configured to adjust the power, torque, speed, direction, and position of the electric motor 138. In another embodiment, the electric motor 138 is replaced with a manual crank (not shown). The manual crank may include a torque-multiplying device, such as planetary gears, to ease the effort required for rotation of the sheave pulley 136. In other embodiments, the sheave pulley 136 is rotated by any suitable device.

In the illustrated embodiment shown in FIG. 2, the sheave assembly 130 further includes a first guide pulley 140 and a second guide pulley 142. The guide pulleys 140 and 142 provide alignment for the line 128, and increase the wrap of the line 128 on the sheave pulley 136 to increase grip during operation. In another embodiment, a single guide pulley is used in the sheave assembly 130. In other embodiments, any number of guide pulleys is used to align the line 128 and increase the contact of the line 128 with the sheave pulley 136.

Figure 4:
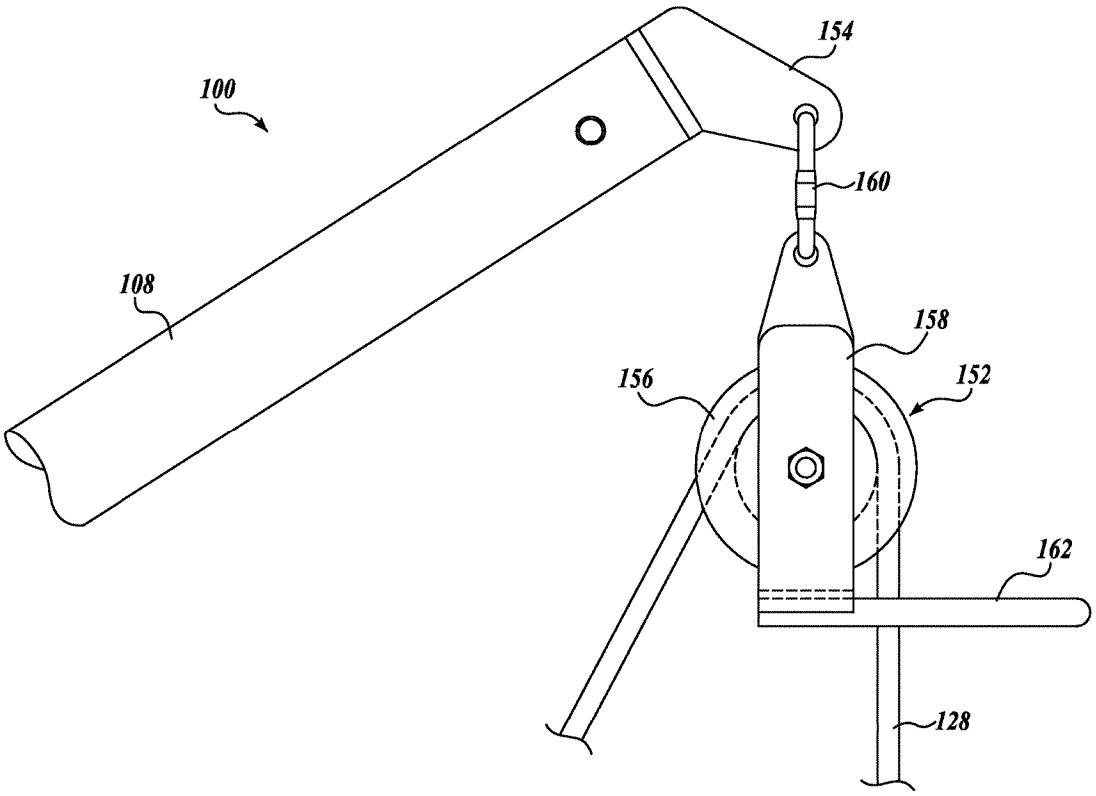
FIG. 4 is a close-up elevational view of the lifting assembly of the portable davit of FIG. 1.

As shown in FIGS. 2 and 4, the load L is raised and lowered through a lifting assembly 152. The lifting assembly 152 is supported with a lifting bracket 154 mountable to the distal end of the jib 108 (opposite the coupling 118). The lifting assembly 152 includes a lifting pulley 156. A pulley carrying bracket 158 and a link 160 connect the lifting pulley 156 to the jib 108. The lifting pulley 156 guides the line 128 from the sheave assembly 130 to the load L. In this regard, the lifting pulley 156 provides a location for load transfer at the end of the jib 108. In the illustrated embodiment, a guide loop 162 is connected to the distal end of the pulley carrying bracket 158 (opposite the link 160), to prevent the line 128 from disengaging the lifting pulley 156. The guide loop 162 is configured such that the line 128 passes through the guide loop 162 before removably coupling to the load L.

In some embodiments of the present disclosure, various joints and mounts utilize devices to allow quick disassembly of the portable davit 100. For example, a type of fastener removable without tools, such as a quick-release pin, is used. Pin 116 is depicted as a quick-release pin in FIG. 6. A quick-release pin is used at locations where quick disassembly is desired, for example, the coupling 118, the mast tab 124, the jib tab 126, the first sheave mount 132 (see sheave pin 164 in FIG. 7), and the second sheave mount 134. Likewise, in one embodiment, the link 160 is a quick-release link, such as a carabineer.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The embodiments of the invention in which an exclusive property or privilege is claimed are defined as follows:

1. A portable davit for raising, lowering, and transporting a load, comprising:

(a) a first davit mount for removably mounting the portable davit to a horizontal mounting surface;

(b) a second davit mount spaced a distance from the first davit mount and configured for mounting the portable davit to a vertical mounting surface, the second davit mount having a locking bore and a collar joint;

(c) an elongate mast rotatably couplable to the first and second davit mounts, the elongate mast having a proximal end and a distal end, the distal end configured to interface the first davit mount, the elongate mast extending axially from the first davit mount through the collar joint of the second davit mount, such that the second mount is positioned between the proximal and distal ends of the elongate mast;

(d) a jib hingedly coupled to the proximal end of the elongate mast, wherein the jib is positionable at a desired lifting angle; and (e) a pulley system supported by the elongate mast and the jib, the pulley system having a sheave mounted on the elongate mast between the second davit mount and the proximal end, wherein the pulley system comprises a line removably couplable to the load, wherein the collar joint is configured to surround the elongate mast, the collar joint having a first positional bore configured to align with the locking bore at a first rotational position of the elongate mast relative to the first and second davit mounts, wherein the collar joint facilitates rotation of the mast relative to the first and second davit mounts, and wherein a pin inserted through the first positional bore and through the locking bore locks the elongate mast at the first rotational position.

2. The portable davit of claim 1, wherein the sheave is operable to pay out and reel in the line.

3. The portable davit of claim 2, wherein the sheave is drivingly connected to a motor.

4. The portable davit of claim 3, wherein the motor is electric powered.

5. The portable davit of claim 4, wherein the motor is configured for controlling the level of torque applied by the motor to the sheave.

6. The portable davit of claim 3, wherein the motor is configured to adjust the torque and speed of the driving connection to the sheave.

7. The portable davit of claim 2, wherein the pulley system further comprises a lifting pulley mountable on the jib, the lifting pulley guiding the line between the sheave and the load.

8. The portable davit of claim 7, wherein the lifting pulley further comprises a guard coupled to the pulley system, wherein the guard is configured to interface the line.

9. The portable davit of claim 1, further comprising a handle coupled to the collar joint, wherein the handle is configured to rotate the mast relative to the first and second mounts.

10. The portable davit of claim 1, wherein the mast is manufactured from a material selected from the group consisting of aluminum, titanium, carbon fiber, steel, stainless steel, iron, polyvinyl chloride, acrylonitrile butadiene styrene, and fiberglass.

11. The portable davit of claim 1, wherein the jib is manufactured from a material selected from the group consisting of aluminum, titanium, carbon fiber, steel, stainless steel, iron, polyvinyl chloride, acrylonitrile butadiene styrene, and fiberglass.

12. The portable davit of claim 1, wherein the portable davit further comprises an actuator extending between the mast and the jib, wherein the actuator is operable to adjust the lifting angle between the mast and the jib, and wherein the actuator is coupled to the mast and the jib with pinned joints.

13. The portable davit of claim 12, wherein the actuator is operated by one of the following systems: hydraulic, electrical, or manual.

14. The portable davit of claim 1, wherein the lifting angle is adjustable between about 50 degrees and 150 degrees.

15. The portable davit of claim 1, wherein the collar joint comprises a second positional bore at a second rotational position of the mast relative to the first and second mounts, wherein the pin is inserted through the second positional bore and the locking bore to lock the mast at the second rotational position.

16. A portable davit for raising, lowering, and transporting a load, comprising:

(a) a first davit mount and a second davit mount for removably mounting the portable davit to a structure in a spaced apart configuration, the second mount having a locking bore and a collar joint;

(b) an elongate mast rotatably couplable to the first and second davit mounts, the elongate mast having a proximal end and a distal end, the distal end configured to interface the first davit mount, the elongate mast extending axially from the first mount through the collar joint of the second mount, such that the second mount is positioned between the proximal and distal ends of the elongate mast;

(c) a jib hingedly coupled to the proximal end of the elongate mast;

(d) an actuator connected to the elongate mast between the second mount and the proximal end and connected to the jib, wherein the actuator is operable to adjust a lifting angle between the elongate mast and the jib; and (e) a pulley system for raising and lowering the load, comprising:

(i) a line removably couplable to the load;

(ii) a sheave mounted on the elongate mast between the second mount and the proximal end, the sheave operable to pay out and reel in the line, wherein the sheave is drivingly connected to a motor; and (iii) a lifting pulley mountable on the jib, the lifting pulley guiding the line between the sheave and the load wherein the collar joint is configured to surround the elongate mast and facilitate rotation of the elongate mast relative to the first and second davit mounts, the collar joint having a first positional bore configured to align with the locking bore at a first rotational position and a second positional bore configured to align with the locking bore at a second rotational position, wherein a pin inserted through the first positional bore and through the locking bore locks the elongate mast at the first rotational position, and wherein the pin inserted through the second positional bore and through the locking bore locks the elongate mast at the second rotational position.

* * * * *